United States Patent [19]

Moody

[11] Patent Number: 5,065,688

[45] Date of Patent: Nov. 19, 1991

[54] FLEXIBLE WEAPON HANDLING SUPPORT SYSTEM

[75] Inventor: Paul E. Moody, Barrington, R.I.

[73] Assignee: The United States of America as represented by the Secretary of the Navy

[21] Appl. No.: 544,294

[22] Filed: Jun. 20, 1990

[51] Int. Cl.[5] ..... B63G 8/32

[52] U.S. Cl. ..... 114/238; 114/316; 410/47

[58] Field of Search ..... 248/671, 678, 680, 681; 24/68 CD, 68 C; 244/118.1, 137.1; 114/75, 238, 239, 316; 410/97, 47, 49, 50; 414/608

[56] References Cited

U.S. PATENT DOCUMENTS

| | | | |
|---|---|---|---|
| 2,683,051 | 7/1954 | Christophersen | 24/68 C |
| 2,684,825 | 7/1954 | Laviana et al. | 248/671 |
| 2,954,951 | 10/1960 | Dorothea | 248/671 |
| 3,028,130 | 4/1962 | Burton | 244/137.1 |
| 3,753,407 | 8/1973 | Tilseth | 410/97 |
| 4,184,801 | 1/1980 | Nicoloff et al. | 114/238 |
| 4,412,774 | 11/1983 | Legrand et al. | 248/671 |
| 4,685,412 | 8/1987 | Harris et al. | 114/238 |
| 4,804,162 | 2/1989 | Rice | 248/671 |
| 4,923,148 | 5/1990 | Fillingham et al. | 244/137.1 |

*Primary Examiner*—Sherman Basinger
*Assistant Examiner*—Stephen P. Avila
*Attorney, Agent, or Firm*—Michael J. McGowan; Prithvi C. Lall; Michael F. Oglo

[57] ABSTRACT

A dolly system having a pair of flexible lashing straps which are tightened by a single turnbuckle. The upper clamps to which the lashing straps attach are reversible, one position having an arcuate surface with a contour matching a first weapon diameter, D1, and the other position having an arcuate surface contour matching a second larger weapon diameter, D2. The strap connection point on this double contoured clamp piece permits the same lashing straps to be used for both weapon diameters. Further, each dolly has two reversible bottom clamping pads, each with an arcuate surface contour that selectively matches either the D1 or the D2 weapon diameter. Each bottom pad is held in place with a pivot pin and a position pin, each of which is of a quick release type. The primary advantage of such a dolly system is that storage of present size weapons is relatively unaffected by providing this future growth potential.

5 Claims, 2 Drawing Sheets

FLEXIBLE WEAPON HANDLING SUPPORT SYSTEM

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates to a weapon storage means and more particularly to a means for providing a submarine weapon handling support system which accommodates storage of two different diameter weapons.

(2) Description of the Prior Art

Weapon launch tubes on newer submarines must be at least 30" in diameter in order to provide the capability of ejecting, or permitting swimout of, present 21 inch diameter weapons as well as to provide growth space for future larger diameter weapons. Use of larger diameter weapons, however, significantly effects the torpedo handling system in areas such as storage spacing and support structures depending upon how big and how heavy such larger weapons are. What is needed is a torpedo handling system that will accommodate both existing and future, larger and heavier weapons.

SUMMARY OF THE INVENTION

Accordingly, it is a general purpose and object of the present invention to provide a flexible dolly means for storing two different weapon sizes.

Another object is that by providing a single support system for two different size weapons the need for stowage of separate diameter weapon support apparatus within the torpedo room, when not in use, is eliminated.

It is a further object that such dolly means eliminate the need for two customized support systems for the two different size weapons.

Another object is that such dolly means employ quick release pins to facilitate reversing support pads.

Still another object is that such storage means use the same strap and support dollies for both weapon sizes.

A still further object is that the two tightening bolts per lashing strap presently used be replaced by a single turnbuckle mechanism.

These objects are accomplished with the present invention by providing a dolly system having a pair of flexible lashing straps which are tightened by a single turnbuckle. The upper clamps to which the lashing straps attach are reversible, one position having an arcuate surface with a contour matching a first weapon diameter, D1, and the other position having an arcuate surface contour matching a second larger weapon diameter, D2. The strap connection point on this double contoured clamp piece permits the same lashing straps to be used for both weapon diameters. Further, each dolly has two reversible bottom clamping pads, each with an arcuate surface contour that selectively matches either the D1 or the D2 weapon diameter. Each bottom pad is held in place with a pivot pin and a position pin, each of which is of a quick release type. The primary advantage of such a dolly system is that storage of present size weapons is relatively unaffected by providing this future growth potential.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein.

DESCRIPTION OF THE PREFERRED EMBODIMENT

Figure 1:
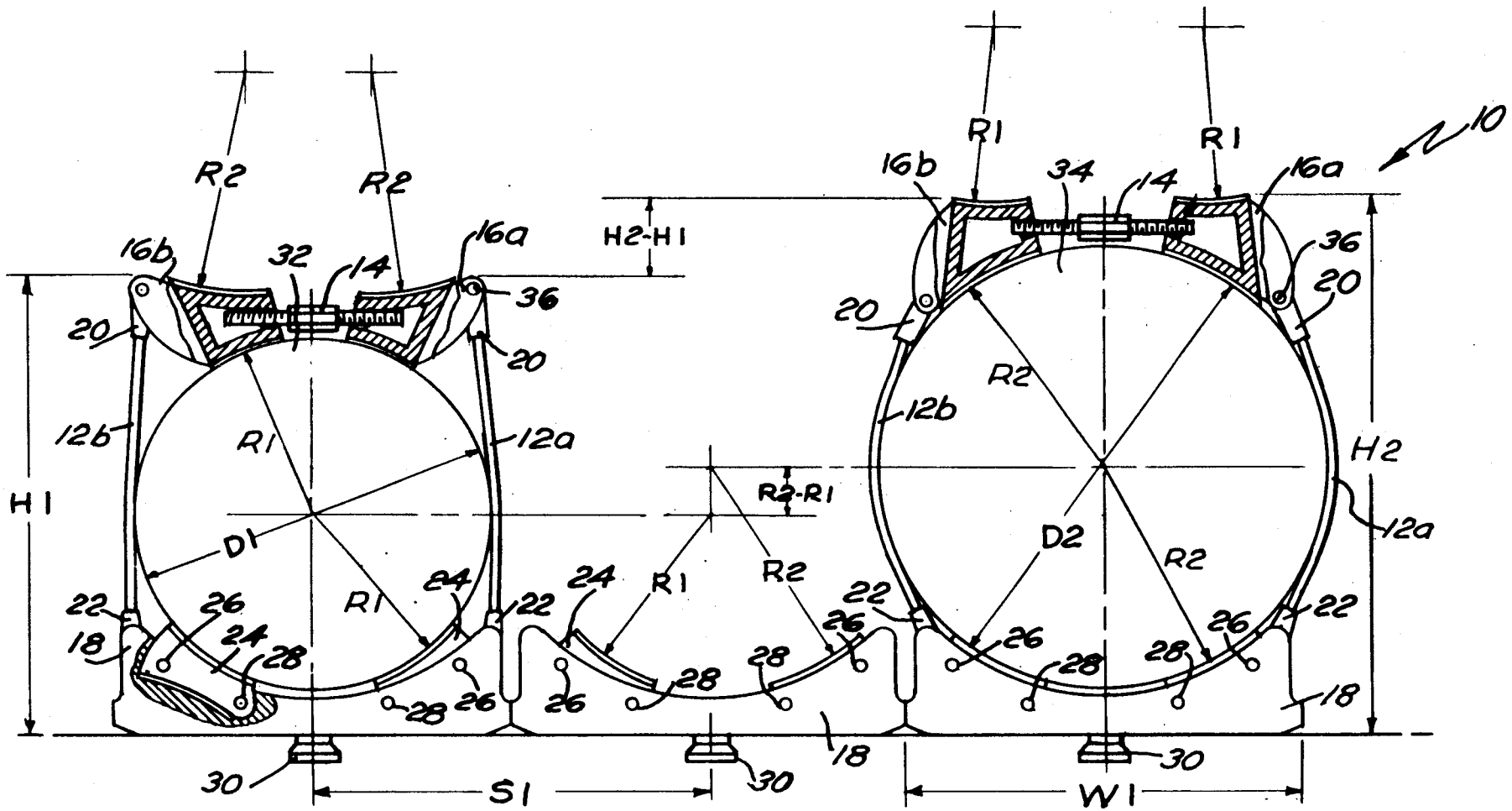
FIG. 1 shows a front view of a flexible weapon handling support system according to the present invention.

Referring now to FIG. 1 there is shown an arrangement of weapon storage devices 10, each device 10 comprising two flexible dolly lashing straps 12*a* and 12*b*, a turnbuckle 14 which is disposed between and threadably attached to first and second upper clamps 16*a* and 16*b*, and a dolly base 18 having a preselected width W1. Lashing straps 12*a* and 12*b* connect, at the top ends 20 thereof to upper clamps 16*a* and 16*b* respectively and, at the bottom ends 22 thereof, to protrusions on dolly base 18. Dolly base 18 further includes first and second reversible pads 24, each of which are attached to dolly base 18 by means of a pivot pin 26 and a position pin 28. Dolly base 18 also has a "button" 30 mounted on the bottom surface thereof for securing device 10 to slots (not shown) in the weapon handling support structure. Upper clamps 16*a* and 16*b* are reversible. In one position the clamps have a radius R1 which matches the contour of a weapon 32 having a relatively small diameter D1, e.g., 21 inches, while in the other position a radius R2 matches the contour of a weapon 34 having a larger diameter D2, e.g., 26.5 inches. It is noted that the weapon diameters described are merely exemplary and may be varied within the spirit and scope of the invention. Due to the standoff and strap connecting point positioning of the strap connection point protrusions 36 on the double contour surfaced upper clamps 16*a* and 16*b*, the same straps 12*a* and 12*b* can be used for both size weapons. In addition, each base bottom pad 24 is reversible with the radii R1 or R2 selected to match either a D1 or D2 diameter weapon. Pivot pin 26 and position pin 28 can each be quick release type pins. The system utilizes standard weapon dolly lashing straps 12*a* and 12*b*, and well known strap release mechanisms (not shown).

It is further noted that in FIG. 1 width W1 of base 18 is less than that of weapon diameter D2 and is selected such that when adjacent dolly systems 10 are placed side by side the dolly-to-dolly spacing S1 equals W1. In this configuration, the width of the body of a weapon of diameter D2 encroaches somewhat into the area above the adjacent base 18 thus requiring that the adjacent dolly be left empty as shown in FIG. 1. Heights H1 and H2 also differ based upon the weapon diameter selected. For example, a 26.5 inch diameter was selected as the larger weapon size in the preferred embodiment in order to permit installation of acoustic material on the inside of the torpedo launch tube between the weapon and the inside diameter of a 30 inch tube barrel. As long as the larger weapon is 26.5 inch in diameter or less, this acoustic material then does not interfere with the weapon.

Figure 2:
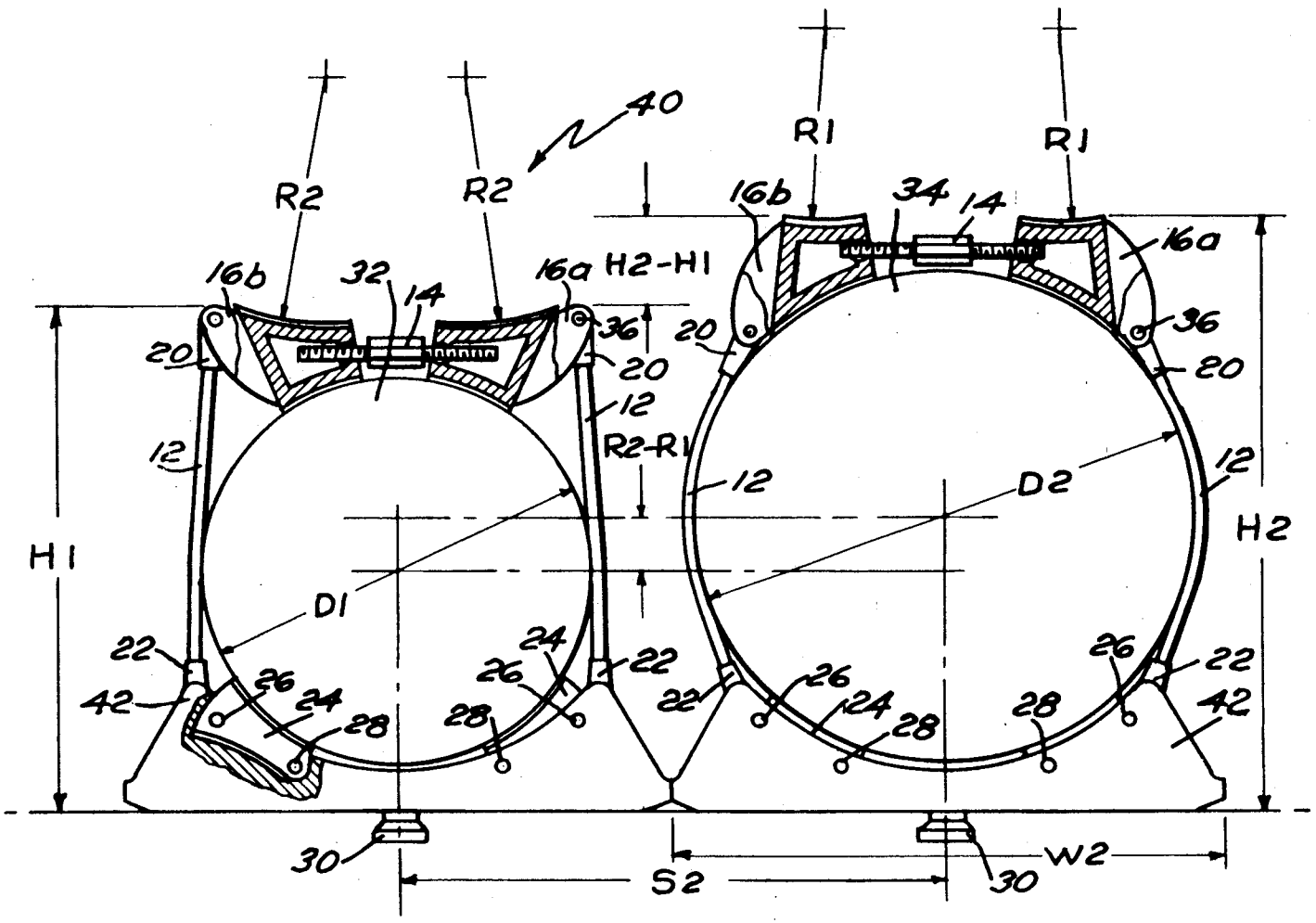
FIG. 2 shows a front view of an alternate embodiment of the flexible weapon handling support system of FIG. 1.

FIG. 2 shows an alternative configuration of device 10 of FIG. 1 in which a weapon storage device 40 employs a dolly base 42 that is wider than dolly base 18 of FIG. 1. All remaining components used in the device of FIG. 1 remain unchanged in system 40 of FIG. 2. The method of securing weapons 32 and 34 also remains unchanged; however, width W2 of dolly base 42 is increased such that W2>D2. The primary advantage of this embodiment is that the dolly support system spacing can be optimized for the larger weapons and therefore a greater number of large weapons can fit in the torpedo room. Of course, fewer D1 diameter weapons can be stored in a torpedo room configured in this manner, as no more of the small diameter weapons can be stowed in the torpedo room than can large diameter weapons thereby reducing the number of small weapons stowable by approximately the same proportion as the ratio of base growth [W2−W1]/W1 which can be on the order of 20 to 25%.

The primary advantage of a dolly system which supports two different diameter weapons is that an original ship design and stowage capability would be relatively unaffected by providing this future growth potential. This is a result of the dolly lock positions being identical for both size weapons and the support structure for the weapons then needing only to be designed for S1 or S2 dolly lock spacing. This feature provides the capability to maximize weapon storage capability with either a standard (21" diameter) or a larger diameter weapon. FIG. 1 shows that larger diameter weapons stowage is not maximized because the D2 diameter weapon is wider than dolly width W1. Therefore, no weapons can be stowed adjacent to a larger weapon. Conversely, FIG. 2 shows that standard diameter weapon stowage is not maximized because the D1 diameter weapon is smaller than dolly width W2. The impact of the increased weight of the larger weapon, however, will not affect the total structural load carrying requirements of the support structure because a smaller number of larger weapons can be stowed in the torpedo room as compared to a full room of D1 diameter weapons. While a detailed layout of a particular torpedo room arrangement would have to be made in order to determine the exact number of D2 diameter weapons that can be stowed in a particular torpedo room, it is notable that one D2 diameter weapon normally weighs only about 83% of the weight of two D1 diameter weapons of equal length and density. A second advantage over existing dolly systems is that the present dolly lashing straps are tightened using a single turnbuckle in lieu of the two tightening bolts required in the prior art systems.

What has thus been described is a dolly system having a pair of flexible lashing straps which are tightened by a single turnbuckle. The upper clamps to which the lashing straps attach are reversible, one position having an arcuate surface with a contour matching a first weapon diameter D1, and the other position having an arcuate surface contour matching a second larger weapon diameter weapon D2. The strap connection point on this double contoured clamp piece permits the same lashing straps to be used for both weapon diameters. Further, each dolly has two reversible bottom clamping pads, each with an arcuate surface contour that selectively matches either the D1 or the D2 weapon diameter. Each bottom pad is held in place by a pivot pin and a position pin, each of which is of a quick release type.

Obviously many modifications and variations of the present invention may become apparent in light of the above teachings. For example: the inventions primary intent is to show a dolly/lashing strap mechanism that can accommodate two different weapon sizes without compromising the stowage capacity for the smaller diameter weapon. The system configuration would vary depending upon the size of the larger weapon, a detail stress and shock analysis, material selection and roll stability analysis. For example, the dolly could be designed with two buttons in the lower track, in lieu of one (as shown) to improve the roll stability of the system.

In light of the above, it is therefore understood that within the scope of the appended claims, the invention may be practiced otherwise than as specifically described.

What is claimed is:

1. Apparatii for storing and restraining cylindrical weapons of preselected smaller and larger diameters D1 and D2 respectively onboard a submarine, said submarine having a pre-configured weapon support structure for receiving said apparatii so as to produce a preplanned weapon storage arrangement, each said apparatus comprising:

a base means, affixed to said weapon support structure of said submarine, said base means providing a support cradle to said weapon, said base means further comprising, a dolly base having a preselected width and at least one button attached to the underside thereof, said dolly base being affixed to said support structure by said at least one button, first and second bottom pads, each said bottom pad having a first arcuate surface on one side thereof of diameter D1 and a second arcuate surface on the obverse side of a diameter D2 adjustably attached to said dolly base, for selectably supporting a preselected weapon diameter, first and second pivot pins, one each moveably attached through a corresponding said bottom pad to said dolly base at a point near the outer extremity of said dolly base, and first and second position pins, one each moveably attached through a corresponding said bottom pad to said dolly base at point near the button on said dolly base;

a pair of flexible lashing straps of equal length, one end of each said flexible strap being attached to said base means, extending generally vertically from said base means and contacting the outer surface of said weapon, for securing said weapon to said base means; and clamping means, in contact with the top outer cylindrical surface of said weapon and attached to the other end of said pair of flexible lashing straps, for providing, in cooperation with said flexible lashing straps and said base means, said storage and restraint of said weapon.

2. The apparatus of claim 1 wherein said clamping means further comprises:

first and second upper clamps, each said upper clamp having a first arcuate surface on one side thereof of diameter D1, a second arcuate surface on the obverse side thereof of diameter D2 and a threaded aperture therein aligned on a generally horizontal axis with respect thereto, for providing clamping surfaces of a diameter matching the diameter of said bottom pads and in contact with the top cylindrical surface of said weapon; and a turnbuckle, threadably attached to each of said first and second upper clamps, for providing, upon tightening, the motive force to pull said first and second upper clamps toward each other thereby tightening said pair of flexible lashing straps so as to compressively secure said weapon by producing inwardly directed contact forces at said arcuate surfaces of said first and second upper clamps and said first and second bottom pads.

3. The apparatus of claim 2 wherein said pivot pins and said position pins are of a quick release type.

4. The apparatus of claim 3 wherein said dolly base width is greater than the diameter D2 of said larger weapon.

5. The apparatus of claim 3 wherein said dolly base width is greater than the diameter D1 of said smaller weapon but less than the diameter D2 of said larger weapon.

* * * * *